US008416161B2

(12) United States Patent
Kawabe

(10) Patent No.: US 8,416,161 B2
(45) Date of Patent: Apr. 9, 2013

(54) EMISSIVE DISPLAY DEVICE DRIVEN IN SUBFIELD MODE AND HAVING PRECHARGE CIRCUIT

(75) Inventor: Kazuyoshi Kawabe, Yokohama (JP)

(73) Assignee: Global OLED Technology LLC, Hemdon, VA (US)

( * ) Notice: Subject to any disclaimer, the term of this patent is extended or adjusted under 35 U.S.C. 154(b) by 0 days.

(21) Appl. No.: 11/572,919

(22) PCT Filed: Jul. 29, 2005

(86) PCT No.: PCT/US2005/027874
§ 371 (c)(1),
(2), (4) Date: Jan. 30, 2007

(87) PCT Pub. No.: WO2006/020511
PCT Pub. Date: Feb. 23, 2006

(65) Prior Publication Data

US 2008/0001862 A1 Jan. 3, 2008

(30) Foreign Application Priority Data

Aug. 11, 2004 (JP) ..... 2004-234902

(51) Int. Cl.
*G09G 3/32* (2006.01)
*G09G 3/30* (2006.01)

(52) U.S. Cl.
USPC ..... 345/82; 345/76

(58) Field of Classification Search ..... 345/44–46, 345/55, 76, 77, 82, 690, 692, 92
See application file for complete search history.

(56) References Cited

U.S. PATENT DOCUMENTS

| | | | | |
|---|---|---|---|---|
| 7,310,092 | B2 * | 12/2007 | Imamura | 345/204 |
| 2002/0140712 | A1 | 10/2002 | Ouchi et al. | |
| 2003/0038760 | A1 | 2/2003 | Kim et al. | |
| 2003/0184505 | A1 | 10/2003 | Inukai et al. | |
| 2004/0090434 | A1 | 5/2004 | Miyazawa | |

FOREIGN PATENT DOCUMENTS

| | | |
|---|---|---|
| EP | 1528533 | 5/2005 |

* cited by examiner

*Primary Examiner* — Kevin M Nguyen
(74) *Attorney, Agent, or Firm* — Global OLED Technology LLC

(57) ABSTRACT

A display device, includes an active matrix display array including pixel circuits arranged in a matrix of columns and rows, each pixel circuit having a current-driven diode emissive element, and a plurality of thin film transistors for controlling the diode emissive element; a data line provided corresponding to each column of the matrix for supplying a data signal to a pixel circuit in the corresponding column; a data driver for controlling supply of the data signal to the data line; a select line provided corresponding to each row of the matrix for supplying a select signal to the pixel circuit in the corresponding row; and a gate driver for supplying the select signal to the select line; wherein the data signal is a digital signal indicating "1" or "0" as to whether or not to supply ON or drive current to the diode emissive element.

12 Claims, 17 Drawing Sheets

| | ORDER | PULSE INTERVAL Pi(Tv) | SUBFRAME PERIOD Ti(Tv) | RATIO |
|---|---|---|---|---|
| SFO | 2 | 2 | 2+1/3 | 1 |
| SF1 | 3 | 5 | 4+1/3 | 1.86 |
| SF2 | 1 | 8 | 8+1/3 | 3.57 |
| SF3 | 2 | 16 | 16 | 6.86 |

| | ORDER | PULSE INTERVAL Pi(Tv) | SUBFRAME PERIOD Ti(Tv) | RATIO |
|---|---|---|---|---|
| SFO | 2 | 4 | 3+2/3 | 1 |
| SF1 | 1 | 7 | 7+2/3 | 2.09 |
| SF7-1 | 3 | 256 | 255+2/3 | 69.73 |
| SF2 | 2 | 16 | 15+2/3 | 4.27 |
| SF3 | 1 | 31 | 31+2/3 | 8.64 |
| SF7-2 | 3 | 256 | 255+2/3 | 69.73 |
| SF4 | 2 | 64 | 63+2/3 | 17.36 |
| SF5 | 1 | 127 | 127+2/3 | 34.82 |
| SF6 | 3 | 256 | 255+2/3 | 69.73 |

EMISSIVE DISPLAY DEVICE DRIVEN IN SUBFIELD MODE AND HAVING PRECHARGE CIRCUIT

FIELD OF THE INVENTION

The present invention relates to a display device of an active matrix type including pixel circuits arranged in a matrix, each having a diode type emissive element driven by current, and a plurality of thin film transistors controlling the diode type emissive element.

BACKGROUND OF THE INVENTION

Accompanying recent advances in computerization has been an increasing demand for personal digital assistants having processing capabilities comparable to that of earlier personal computers. As a result, high-resolution and high-quality video display devices fulfilling the requirements of reduced thickness and weight, a wider viewing angle, and smaller power consumption are desired.

In order to meet desired requirements, display devices (or displays) in which thin film active elements (thin film transistors, or simply referred to as TFTs) are formed in a matrix on a glass substrate, and electrooptic elements formed thereon are controlled by the TFT to be driven are being actively developed.

The substrate for forming the thin film active elements is usually formed by providing and patterning a semiconductor film of, for example, amorphous silicon or polysilicon, and making connections using metal wiring lines. Due to differences in electric properties between the thin film active elements, a driving integrated circuit (IC) must be separately provided when amorphous silicon is used while a driving circuit can be formed on the substrate when polysilicon is used.

In liquid crystal displays (hereafter simply referred to as LCDs) currently in widespread use, amorphous silicon is most commonly used in larger size displays, while polysilicon has become the standard material used for medium and small sizes because it is suited for providing higher resolution.

Regarding organic electroluminescence (organic EL) type displays having characteristics of self-emissiveness, reduced thickness and weight, and a wider viewing angle, only polysilicon type displays are mass produced.

Generally, an organic EL element is combined with a TFT to utilize a voltage current controlling function thereof for controlling a current. The voltage current controlling function is the function to control a current between a source and a drain by applying a voltage to a gate terminal of a TFT. By setting a voltage of the gate terminal of the TFT supplying a driving current to the organic EL element to a voltage in accordance with luminance data (tone data), the driving current in accordance with luminance data can be supplied to the organic EL element to adjust intensity of emitted light, and to therefore display an image in a desired tone.

However, when such a configuration is employed, the intensity of light emitted from the organic EL element is very sensitive to the properties of the TFTs. Polysilicon TFTs, particularly so-called "low-temperature polysilicon TFTs", i.e. TFTs formed through a low temperature process, tend to exhibit relatively significant variation in electric properties even between adjoining pixels, which is one of the main factors for deterioration in display quality, particularly in display uniformity on the screen, of the organic EL displays.

One conventional technique for addressing this problem is disclosed in Patent Document 1 (Japanese Patent Laid-Open Publication No. 2002-297094). According to this conventional technique, a polysilicon TFT for driving the organic EL element is used as a switch. Variation in properties is suppressed by operating the switch only in two modes of ON and OFF (digital driving), and multiple tones can be achieved by controlling the length of the ON period.

However, when such a polysilicon TFT is used as a switch to drive the organic EL element based on whether or not to apply a voltage thereto, a driving voltage is raised in relatively a short time, and an ON current is decreased due to deterioration of the organic EL element with time. The pixel with the reduced ON current is visible on the display due to burn-in, and the useable lifetime of the display device shortened.

SUMMARY OF THE INVENTION

A display device, comprising:

an active matrix display array including pixel circuits arranged in a matrix of columns and rows, each pixel circuit having a current-driven diode emissive element, and a plurality of thin film transistors for controlling the diode emissive element;

a data line provided corresponding to each column of the matrix for supplying a data signal to a pixel circuit in the corresponding column;

a data driver for controlling supply of the data signal to the data line;

a select line provided corresponding to each row of the matrix for supplying a select signal to the pixel circuit in the corresponding row; and a gate driver for supplying the select signal to the select line; wherein:

the data signal is a digital signal indicating "1" or "0" as to whether or not to supply ON or drive current to the diode emissive element.

The data driver preferably supplies a predetermined OFF potential to the data line when the ON current is not supplied.

The display device preferably further comprises a precharge circuit for supplying a predetermined precharge voltage to the data line before the data signal is supplied, wherein the precharge circuit supplies the predetermined OFF potential to the data line.

The data driver preferably determines the "1" or "0" value of the data signal in a plurality of sub frames within one frame for each pixel based on display data for each pixel in one frame, and supplies the data signal to the data line for each sub frame.

Preferably, the data driver sequentially supplies to one data line the data signal for a pixel in a different sub field and a different row, and the gate driver sequentially selects a select line for a row to which the data signal supplied to the data line is to be supplied in synchronism with the supply of the data signal.

The display device preferably further comprises an auxiliary circuit connected to the data line, wherein the auxiliary circuit is capable of supplying part of the ON current of the data signal supplied from the data driver to the data line.

Preferably, the auxiliary circuit includes a transistor for supplying part of the ON current supplied to the data line, and a capacitor for storing a gate voltage of the transistor in this state, and the pixel circuit drives the diode emissive element with a current in accordance with the voltage stored in the capacitor of the auxiliary circuit.

The auxiliary circuit preferably has a current supplying capability larger than that of the pixel circuit.

The auxiliary circuit is preferably composed of a plurality of auxiliary circuits having different current supplying capabilities for one data line.

Preferably, the auxiliary circuit is provided to be connectable to the data line through a switch, and is connected to the data line at least once in a horizontal period.

Preferably, the data driver is capable of supplying a plurality of data currents to the data line for the same data voltage, and the plurality of data currents are switched within one horizontal period.

The plurality of data currents are preferably supplied to the data line as a current larger than a data current written to a pixel in a first half of one horizontal period.

Pixels are configured so that the organic EL element is driven with a current, and the ON current is supplied to the data line for turning on the organic EL element while the OFF potential is supplied to the data line for turning off the organic EL element and written into the pixel, so that the organic EL element is driven with a current by the driving TFT. As a result, digital driving can be achieved with a fixed current, even when the driving voltage is increased due to deterioration of the organic EL element over time, thereby preventing burn-in of the pixel, and thereby prolonging the working lifetime of the device.

Especially, by utilizing the auxiliary circuit, a relatively large current is supplied to the data line to write data, so that current writing can be finished in a relatively short time.

DESCRIPTION OF PREFERRED EMBODIMENTS

Preferred embodiments of the present invention will now be described in detail with reference to the accompanying drawings.

(1) First Embodiment

Overall Configuration

Figure 1:
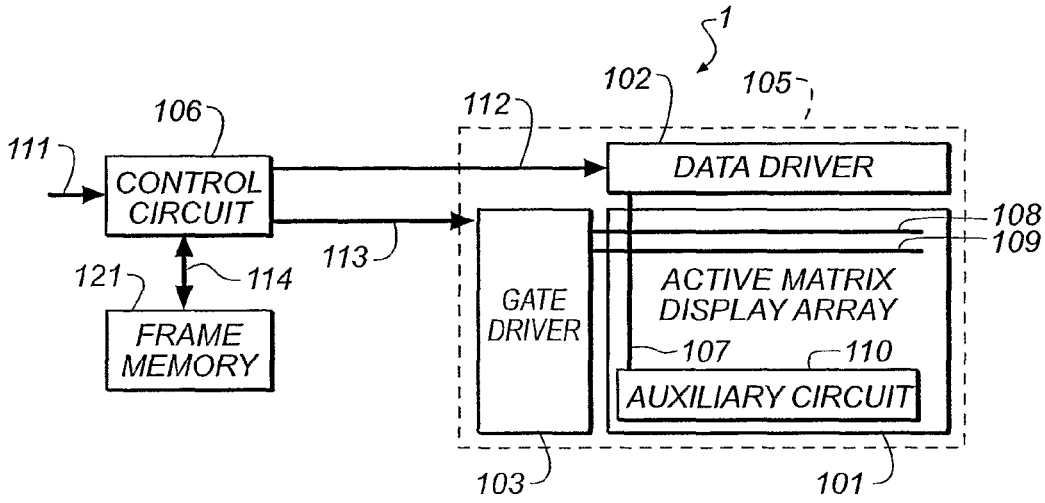
FIG. 1 shows the overall configuration of a device according to a first embodiment of the present invention.

FIG. 1 shows an overall configuration of a device according to a first embodiment of the present invention. An organic EL display 1 includes an active matrix display array 101 having pixels arranged in a matrix, a data driver 102 for supplying a data signal to a data line 107 provided for each column of the display array 101, a gate driver 103 for supplying first and second select potentials to first and second select lines 108 and 109, respectively, provided for each row of the display array, an auxiliary circuit 110 for supplying a portion of a data current on each data line 107, a control circuit 106 for supplying a video signal and a control signal to the data driver 102 through a data control bus 112, and a control signal to the gate driver 103 through a gate control bus 113, a frame memory 121 controlled by the control circuit 106 through a memory bus 114, and an input bus 111 for applying an external video signal, a clock, and the like. The circuits other than the control circuit 106 and the frame memory 121 can all be easily formed on a glass substrate to form a display device 105 through a low-temperature polysilicon process. Although it is more efficient to form the control circuit 106 and the frame memory 121 as separate ICs, it is also possible to form them on a single glass substrate.

The control circuit 106 performs conversion on the external video signal, the clock, and the like to a predetermined level as required, and supply a converted signal to the data driver 102 and the gate driver 103.

While the control circuit 106 and the frame memory 121 can be separately formed by individual ICs, this approach increases the width of the memory bus 114, resulting in increase in number of pins of the control circuit 106, and therefore in package area, cost, and power consumption.

In view of such an increase, the frame memory 121 may be built in the control circuit 106 as an SoC (system on chip) design to be used as a single IC. Alternatively, the control circuit 106 and the frame memory 121 may be contained in one package as an SiP (system in package) design, and the memory bus 114 is provided in the package, thereby decreasing the package area and suppressing an increase in external pins and power consumption.

Currently, a driver with a built-in RAM, i.e. an IC having a RAM (frame memory) integrated into the data driver, is provided as an IC for liquid crystal displays. Thus, the frame memory 121 and the data driver 102 may be integrated and used as an IC.

Pixel Circuit Configuration

A configuration of pixel circuits arranged in a matrix in the active matrix display array 101 for use in the present embodiment will be described with reference to FIG. 2.

The pixel circuit includes an organic EL element 201, a driving TFT 202 for driving the organic EL element 201 with a current, a diode switch TFT 203 for connecting a gate terminal and a drain terminal of the driving TFT 202, a light control TFT 204 for controlling whether or not to light up (supply a current to) the organic EL element 201, a gate TFT 205 for supplying the tone current from the data line 107 into a pixel in a controlled manner, a storage capacitor 206, a current supply line 211 for supplying a current to the organic EL element 201, and a fixed potential line 212 for fixing a potential of one terminal of the storage capacitor 206 at a predetermined value. The fixed potential line 212 may be connected to the current supply line 211.

The driving TFT 202 has a source terminal connected to the current supply line 211, a drain terminal connected to a source terminal of the light control TFT 204 and a source terminal of the diode switch TFT 203, and a gate terminal connected to the other terminal of the storage capacitor 206 that is not connected to the fixed potential line 212, a drain terminal of the gate TFT 205, and a drain terminal of the diode switch TFT 203.

The light control TFT 204 has a gate terminal connected to the first select line 108, and a drain terminal connected to an anode of the organic EL element 201.

The gate TFT 205 has a gate terminal connected to the first select line 108, and a source terminal connected to the data line 107.

The gate terminal of the diode switch TFT 203 is connected to the second select line 109.

The current supply line 211, the fixed potential line 212, and a cathode electrode of the organic EL element are shared by all the pixels.

The driving TFT 202, the diode switch TFT 203, and the light control TFT 204 are P channel TFTs, while the gate TFT 205 is an N channel TFT.

The method of controlling the pixel circuit of FIG. 2 using the data driver 102, the gate driver 103, and the auxiliary circuit 110 will be described later, and a method of driving the organic EL element using the pixel of FIG. 2 will next be described.

Pixel Driving Method

The data signal to be written into the pixel is a binary signal assuming the value of either an ON current or an OFF potential. First, by activating the first and second select lines 108 and 109, the gate TFT 205 is turned on, the light control TFT 204 is turned off, and the diode switch TFT 203 is turned on.

In order to write the ON current, by supplying a desired ON current to the data line 107, the current is supplied from the current supply line 211 through the source and drain terminals of the driving TFT 202, which functions as a MOS diode because the gate and drain terminals thereof is connected by the diode switch TFT 203, the source and drain terminals of the diode switch TFT 203, and the gate TFT 205 to the data line 107.

During this operation, the potential for causing the driving TFT 202 to supply the ON current on the data line 107 is generated at the gate terminal of the driving TFT 202, and stored in the storage capacitor 206.

After this potential is stabilized, the first and second select lines 108 and 109 are deactivated, thereby storing the potential to generate the ON current in the storage capacitor 206 (the gate of the driving TFT 202), such that the driving TFT 202 continues to supply the written ON current to the organic EL element 201 until it is next accessed.

For writing the OFF potential, the first and second select lines 108 and 109 are similarly-turned on, and the potential at which the driving TFT 202 is turned off is supplied to the data line 107, whereby the OFF potential is written into the storage capacitor. After the potential is stabilized, the first and second select lines 108 and 109 are turned off, so that the driving TFT 202 maintains the state of not supplying a current to the organic EL element 201 until it is next accessed.

Figure 2:
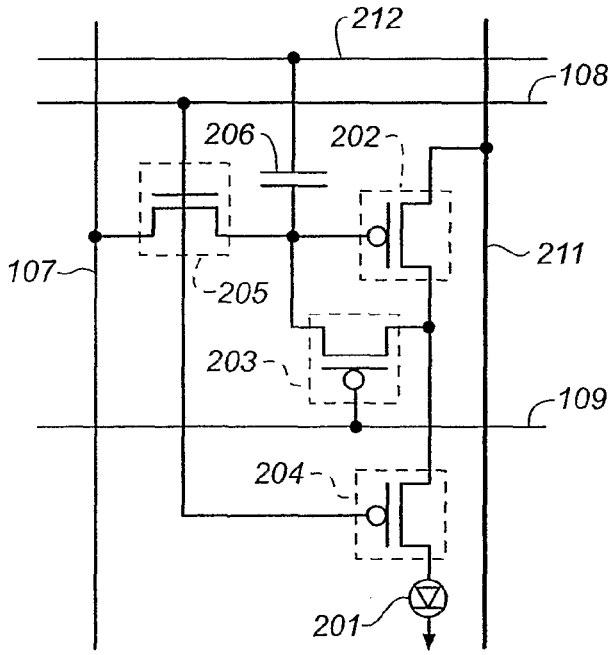
FIG. 2 shows a configuration of a pixel circuit.

When the gate TFT 205 and the diode switch TFT 203 are N type and P type transistors, respectively, as in the pixel circuit of FIG. 2, the gate TFT 205 and the diode switch TFT 203 are active when they are in the "High" state and "Low" state, respectively. As a result, these TFTs are controlled in opposite polarities to each other in this configuration, so that the potential stored in the storage capacitor 206 is less fluctuated by the selection potential of the select lines 108 and 109.

More specifically, the first select line 108 is "High" and the second select line 109 is "Low" while the tone current is written, whereby the effects on the storage capacitor cancel each other. When the lines are deselected, the first and second select lines 108 and 109 are "Low" and "High", respectively, and, again, the effects similarly cancel each other.

By thus configuring the pixel circuit so that a plurality of select lines are controlled in opposite polarities to each other, variation in the potential stored in the storage capacitor 206 can be suppressed.

Figure 3:
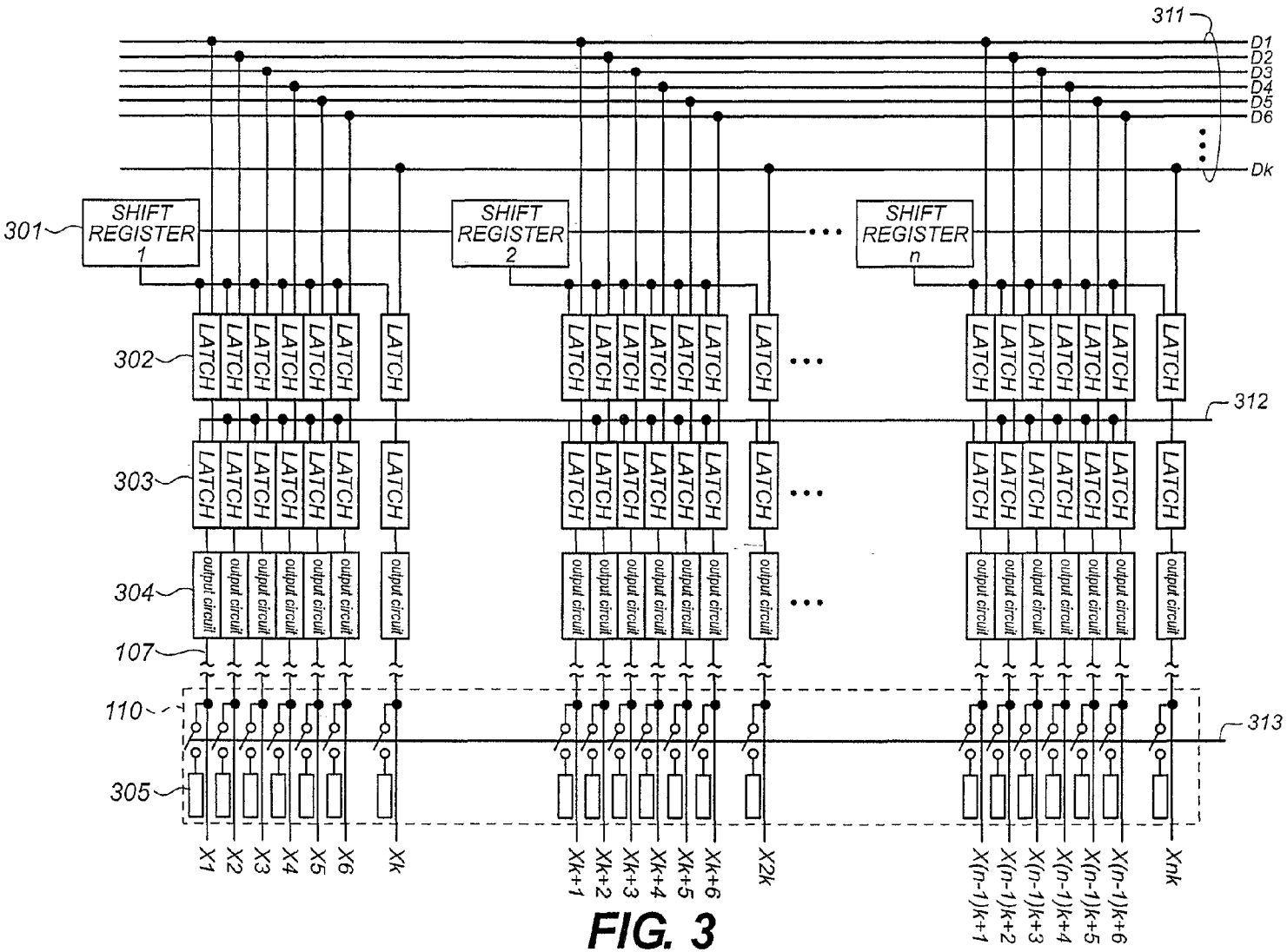
FIG. 3 shows an internal configuration of a data driver.

Configurations of the data driver 102 and the auxiliary circuit 110 used for driving the display array 101 including the pixel circuits of FIG. 2 arranged in a matrix in the above-described manner will next be described with reference to FIG. 3. It should be noted that the configurations of an output circuit 304 in the data driver and an individual auxiliary circuit 305 are illustrated in FIGS. 16A and 16B and FIGS. 17A and 17B, respectively. Also, an internal configuration of the gate driver 103 will be described with reference to FIG. 4.

Data Driver

The data driver 102 includes a shift register 301, a first latch circuit 302 for sequentially latching data for one line, a second latch circuit 303 for storing the data for one line for a predetermined period, the output circuit 304 for supplying the ON current and the OFF potential to the data line 107 based on the latched data, a data bus 311, and a data transfer control line 312.

For digital driving, each data line is driven by the binary value, i.e. the ON current and the OFF potential, and therefore data for one pixel can be transmitted through a single data bus 311. By way of example, when 24 data buses 311 are provided, data for 8 pixels can be transferred at a time in a full color display.

In the above example, the 8-pixel data on the data bus 311 is sequentially transferred to the first latch circuit 302 with the pulse from the shift register 301, and stored as one line data until a next pulse is provided from the shift register. During this period, the data in the first latch 302 is not reflected on the second latch 303. By activating the data transfer control line 312 when the data latching operation for one line is complete, the data in the first latch 302 is transferred to the second latch 303.

The output circuit 304 generates, and supplies to the data line 107, either the ON current or the OFF potential based on the data in the second latch 303.

While the output circuit 304 supplies data to the data line 107, the first latch 302 again sequentially latches the next line data by every 8 pixels in accordance with the shift pulse from the shift register 301. Through repetition of such operations, data for one screen is continuously supplied to the data line 107.

Output Circuit Configuration

Figure 16A:
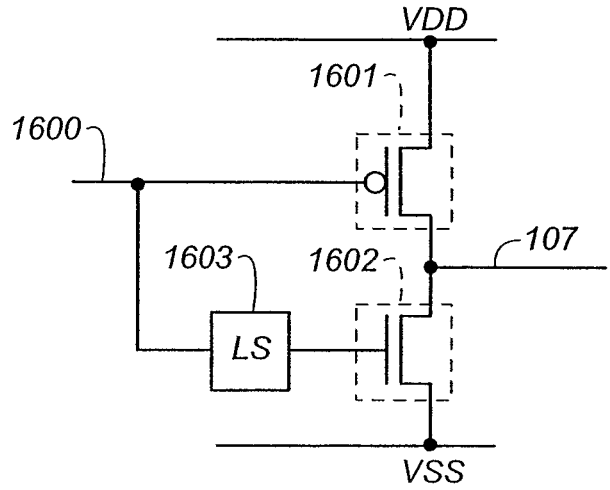
FIGS. 16A and 16B show internal configurations of an output circuit.
Figure 16B:
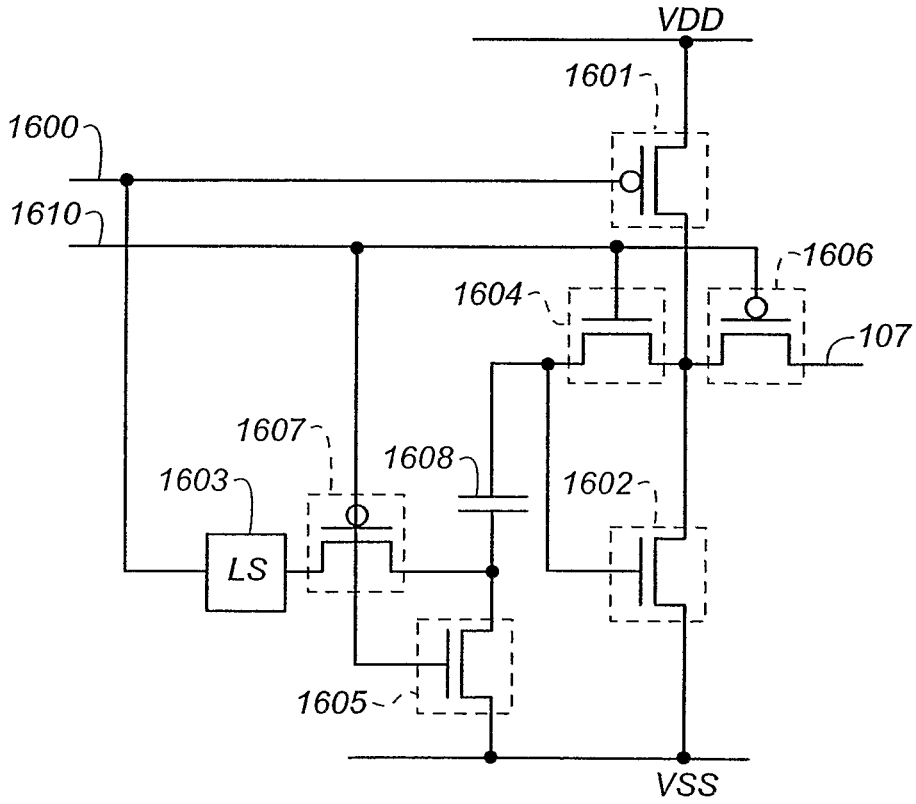

The output circuit 304 is illustrated in FIGS. 16A and 16B. In a simple configuration, the circuit includes a P channel OFF potential switch TFT 1601, an N channel ON current generation TFT 1602, a level shifter 1603, and an input unit 1600, as illustrated in FIG. 16A.

The input unit 1600 is connected to a gate terminal of the OFF potential switch TFT 1601, and an input of the level shifter 1603. The OFF potential switch TFT 1601 has a source terminal connected to a power supply line VDD, and a drain terminal connected to the data line 107.

The ON current generation TFT 1602 has a gate terminal connected to an output of the level shifter 1603, a source terminal connected to the power supply line VSS, and a drain terminal connected to the data line 107.

Because the input unit 1600 is connected to the second latch circuit 303, the ON current or the OFF potential is supplied to the data line 107 based on the data in the second latch circuit 303.

When the latch data in the second latch circuit 303 is "High", the OFF potential switch TFT 1601 is OFF, and the potential obtained by shifting the level of the "High" signal is generated at the output of the level shifter 1603, whereby the ON current generation TFT 1602 generates a current in accordance with the shifted potential, and supplies the current to the data line 107.

When the latch data in the second latch 303 is "Low", the level where the ON current generation TFT 1602 is turned off is generated at the output of the level shifter 303, and the OFF potential switch 1601 is turned on, so that the OFF potential is supplied to the data line 107.

The ON current generated by the ON current generation TFT 1602 is significantly changed by variation in a voltage Vth of the ON current generation TFT 1602, and therefore a Vth correction circuit as illustrated in FIG. 16B is preferably added.

The output circuit having the Vth correction circuit illustrated in FIG. 16B includes, in addition to the elements in the circuit of FIG. 16A, N channel reset TFTs 1604 and 1605, P channel switch TFTs 1606 and 1607, a reset capacitor 1608, and an output control line 1610.

Threshold Voltage Vth Correction

The procedure for correcting the voltage Vth will next be described. By deactivating the output control line 1610, the switch TFTs 1606 and 1607 are turned off, and the reset TFTs 1604 and 1605 are turned on. Turning on the reset TFTs 1604 and 1605 causes a connection between the gate terminal and the drain terminal of the ON current generation TFTs 1602, which then functions as a MOS diode, so that the voltage Vth of the ON current generation TFT 1602 is written into the reset capacitor 1608.

Next, when the output control line 1610 is activated, the reset TFTs 1604 and 1605 are turned off, and the switch TFTs 1606 and 1607 are turned on. As a result, the voltage Vth written in the reset capacitor 1608 is stored, and the output of the level shifter 1603 is connected to one end of the storage capacitor. A gate potential Vgs of the ON current generation TFT 1602 is equal to the sum of Vth and Vls (where Vls is an output potential of the level shifter 1603), so that the gate potential always includes the added voltage Vth.

The ON current generated by the gate potential including the corrected voltage Vth is supplied to the data line 107 through the switch TFT 1606, which is turned on by the active output control line 1610.

Auxiliary Circuit

The auxiliary circuit 110 includes an individual auxiliary circuit 305 connectable to each data line, and an auxiliary circuit enable line 313.

Figure 17A:
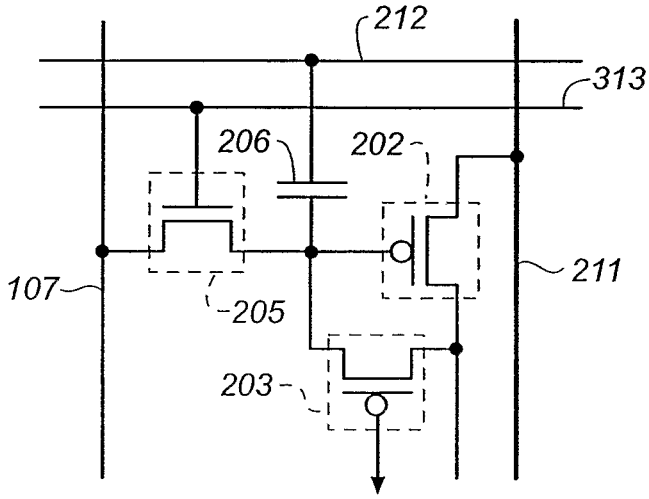
FIGS. 17A and 17B show internal configurations of an auxiliary circuit.
Figure 17B:
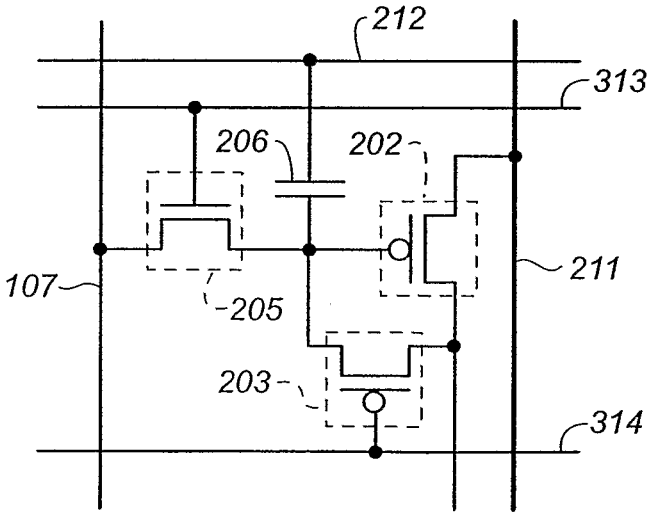

Referring to FIGS. 17A and 17B, the individual auxiliary circuit 305 is similar to the pixel circuit, but does not include the organic EL element 201 and the light control TFT 204 of the pixel circuit, and is formed either as the circuit illustrated in FIG. 17A in which the gate potential of the diode switch TFT 203 is connected to a fixed potential where the diode switch TFT 203 is turned on, or as the circuit illustrated in FIG. 17B connected to a second auxiliary circuit enable line 314 provided similarly to the pixel circuit. The storage capacitor 206 may be omitted from the auxiliary circuit 305 because the current must be supplied only when data is being written into the pixel circuit.

The driving TFT 202 in the auxiliary circuit 305 can supply a larger current than the pixel circuit for the same gate potential (it has a higher current supplying capability). For clarity of the following description, an example will be described wherein the driving TFT in the auxiliary circuit has a current supplying capability (x−1) times (where x is a real number no smaller than 1) that of the driving TFT in the pixel circuit.

Upon writing of the ON current into the selected pixel, a portion of the writing period is consumed due to the wiring capacitance of the data line, which is in the range of several pF to tens of pF. The writing period is shorter for digital driving than that for normal driving. In view of these factors, the current must be written more rapidly.

Consequently, by supplying a larger current to, and more rapidly driving, the data line and by supplying a portion of the current to the auxiliary circuit 305, it can be controlled to supply a desired current to the selected pixel.

Assuming that the ON current "i" is supplied by the driving TFT of the pixel and that the current x*i is supplied to the data line 107, the current (x−1)*i is supplied to the auxiliary circuit because the current supplying capability of the auxiliary circuit is (x−1) times that of the pixel circuit, and therefore the current "i" is supplied to the pixel circuit.

The multiplying factor x for defining the current supplied to the data line 107 is determined in view of the wiring capacitance, access time assigned to the selected pixel, and the like.

When the driving TFTs of the auxiliary circuit 305 and the pixel circuit have different properties, the current written to the pixel differs from a desired value.

Consequently, two-stage control may be performed. More specifically, the auxiliary circuit is connected in a first half of a selection period to supply the current x*i to the data line and rapidly drive the line, and a current approximate to the current "i" is indirectly supplied to the pixel. In a second half thereof, the auxiliary circuit is disconnected from the data line, and the desired current "i" is supplied to the data line to directly write the current "i" to the pixel.

For such control, another circuit of FIG. 16A or FIG. 16B may be provided in the output circuit of the data driver 102 to switch between the current x*i and the current "i", or a binary voltage level may be provided and switched in the level shifter 1603. The ON current "i" and the multiplying factor "x" may be varied for R, G, and B.

Figure 18A:
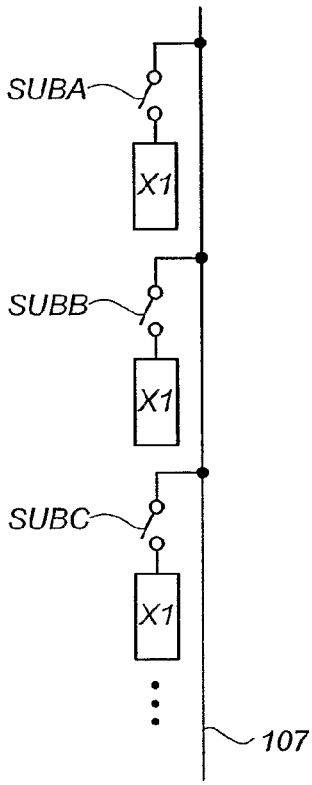
FIGS. 18A and 18B show configurations of a plurality of auxiliary circuits.
Figure 18B:
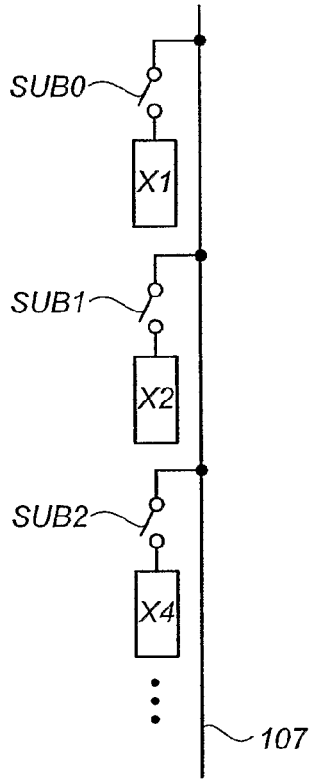

As illustrated in FIGS. 18A and 18B, a plurality of auxiliary circuits 305 may be provided for the data line 107. FIG. 18A shows an example in which a plurality of auxiliary circuits having the equal current supplying capability can be connected to the data line. By activating auxiliary circuit enable lines SUBA, SUBB, and SUBC, the auxiliary circuit to be connected to the data line can be selected.

FIG. 18B shows an example in which a plurality of auxiliary circuits having different current supplying capabilities can be connected to the data line. For example, when four auxiliary circuits having the current supplying capabilities varied as 2 to the power of "n" (2%), a total of 16 different current supplying capabilities can be achieved by activating the auxiliary circuit enable lines SUB0, SUB1, and SUB2, thereby providing adjustment of the current supplying capability.

Gate Driver

An internal configuration of the gate driver 103 will next be described with reference to FIG. 4. The gate driver 103 includes a shift register 401, an enable circuit 402, a level shifter 403, and a buffer 404. The shift register 401 provides an output V1-Vn, and enable control lines E1-E3 are provided.

The enable circuit 402 receives the output Vi (where i is a natural number) of the shift register at one input, and one of the three enable control lines E1-E3 is connected to the other input. More specifically, as illustrated in FIG. 4, the enable control line E1 is connected to the enable circuit 402 connected to the shift register output V1, V4, . . . , V3*i−2, the enable control line E2 is connected to the enable circuit connected to the output V2, V5, . . . , V3*i−1, and the enable control line E3 is connected to the enable circuit connected to the output V3, V6, . . . , V3*i.

The shift register 401 shifts the input pulse by a clock, and provides the shifted pulse at the output Vi. The shift pulse provided from the shift register 401 is selectively enabled by the enable circuit 402 controlled by one of the enable control lines E1-E3, and reflected on the level shifter 403.

The level shifter 403 converts a signal level of the shift register 401 to the signal level at which the gate signal line can be driven. The buffer 404 buffers the signal level of the level shifter 403, and supplies outputs to the first and second select lines 108 and 109 in opposite polarities to each other, thereby driving the select lines to a predetermined potential.

Figure 4:
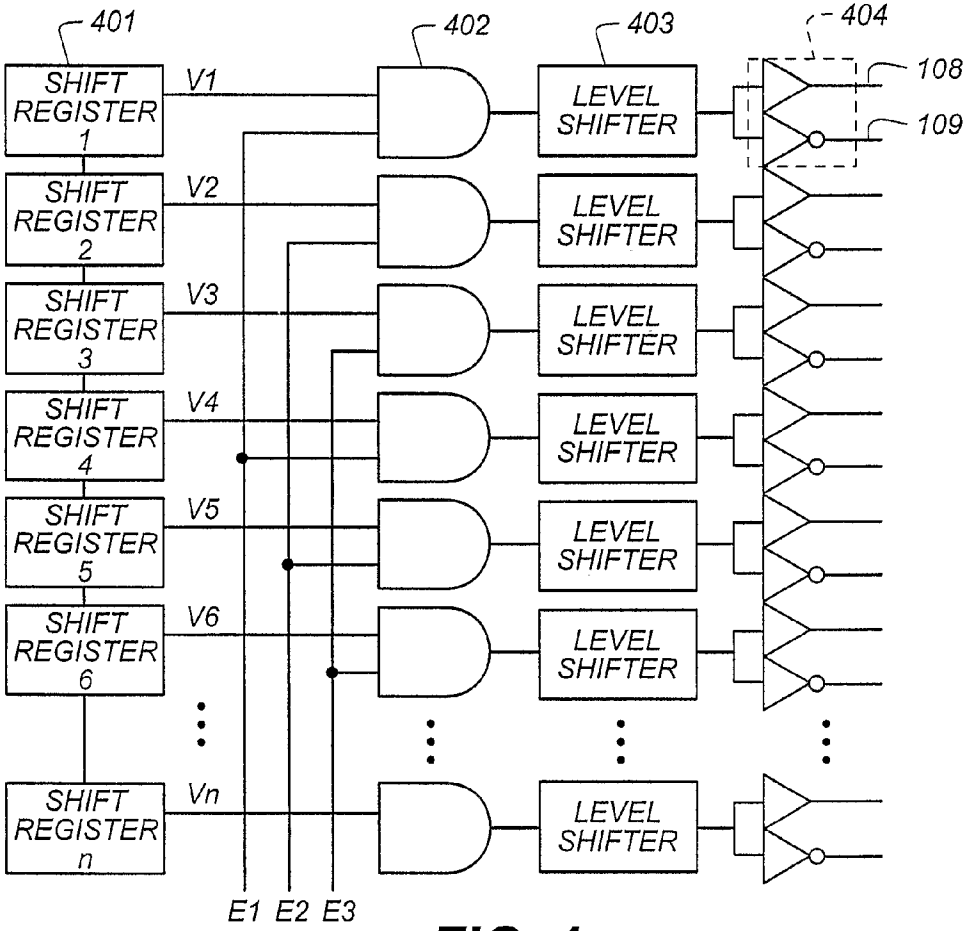
FIG. 4 shows an internal configuration of a gate driver.

While three enable control lines E1-E3 are provided in FIG. 4, the present invention is not limited to such a configuration, and four or more lines may be provided.

Driving Method

A digital driving method performed using the data driver 102, the gate driver 103, and the auxiliary circuit 110 described above will be described in the following.

Figure 5:
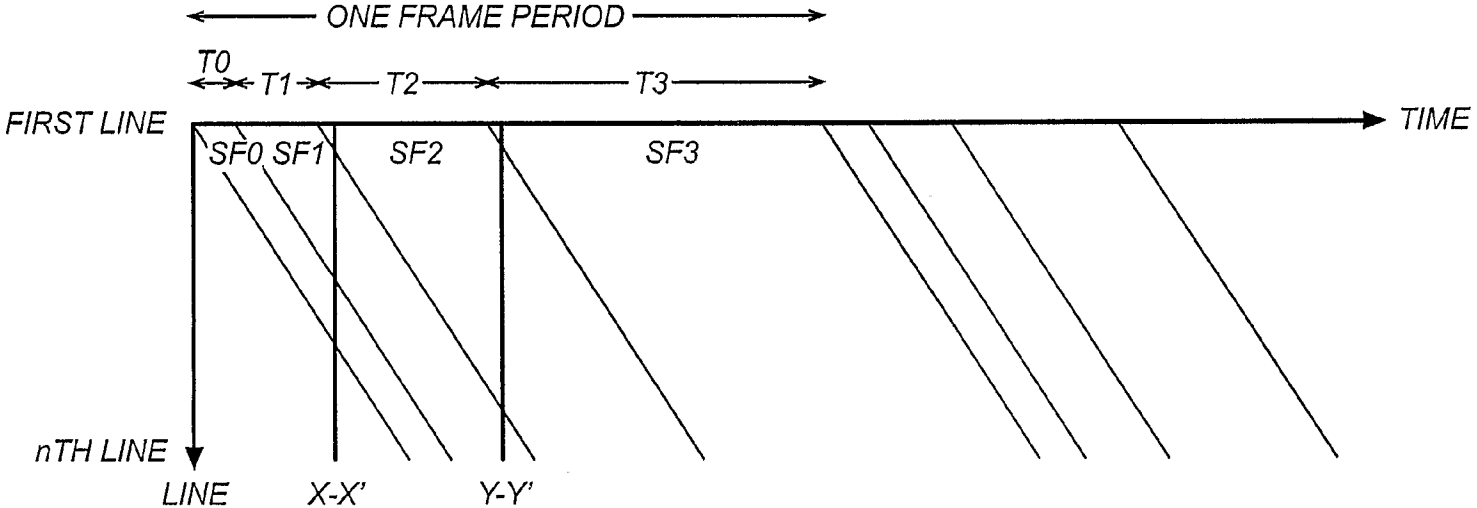
FIG. 5 is a sub frame chart for 4-bit, 16-tone digital driving.

FIG. 5 shows a digital driving sequence in the active matrix display in which time is plotted on the horizontal axis, and the line to which data is written is plotted on the vertical axis. For simplicity of description, FIG. 5 shows an example of 4-bit, 16-tone digital driving.

For digital driving, one frame period is divided into a plurality of sub frames SF0-SFn, and each sub frame period is assigned a weighted display period corresponding to bit data. The sub frame periods T0-T3 shown in FIG. 5 corresponds to bit data D0-D3, respectively. When the bits D0-D3 are "1", the corresponding sub frames SF0-SF3 are ON for the periods T0-T3. When the bits are "0", the corresponding sub frames SF0-SF3 are OFF for the periods T0-T3.

The ON and OFF periods are controlled so that the ratio T0:T1:T2:T3 is approximately equal to 1:2:4:8. Such control enables 4-bit 16-tone display. Naturally, multi-tone display with 6-bit, 8-bit, or the like can be achieved by a similar approach.

Figure 6:
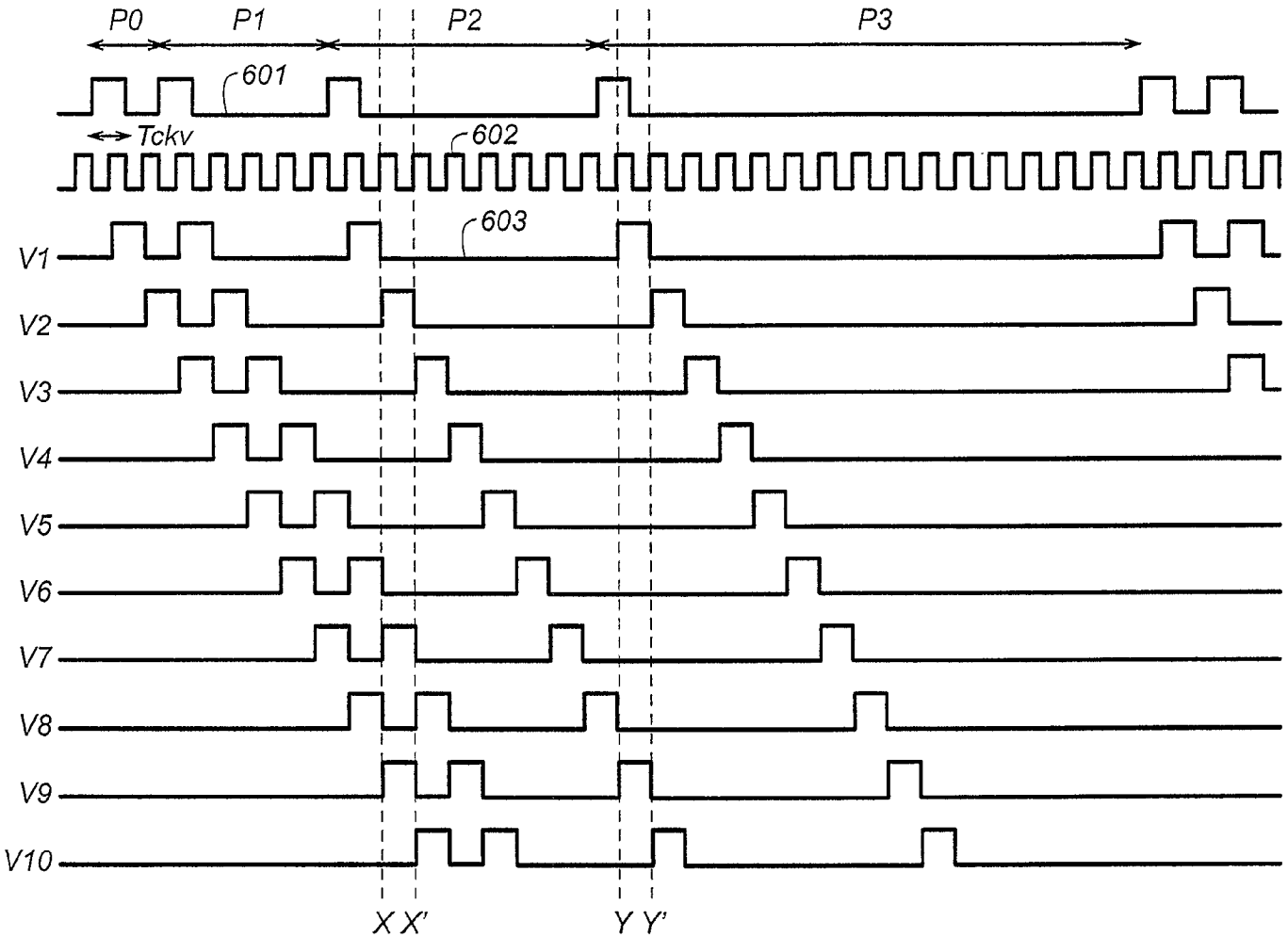
FIG. 6 is a timing chart of the gate driver.

FIG. 6 is a timing chart of the period X-X' in FIG. 5. For simplicity of description, the following relates to the display of 10 lines.

The figure shows an input pulse 601 provided to the shift register of the gate driver 103, a clock 602 having a period Tv for shifting data in the shift register, and an output V1 603 provided from the shift register in the first stage. This pulse is sequentially shifted by each register in accordance with the shift clock 602, and provided to each output Vi (where i=1−10).

The input pulse 601 is provided having predetermined pulse widths P0=2*Tv, P1=5*Tv, P2=8*Tv, and P3=16*Tv.

For the period X-X', the shift register outputs V2, V7, and V9 are "High". As described in connection with the configuration of the gate driver illustrated in FIG. 4, the outputs V2, V7, and V9 are enabled by the enable control lines E2, E1, and E3, respectively, so that the select lines for the second, seventh, and ninth lines can be selected in a tine-divisional manner.

Time Divisional Selection

Figure 7:
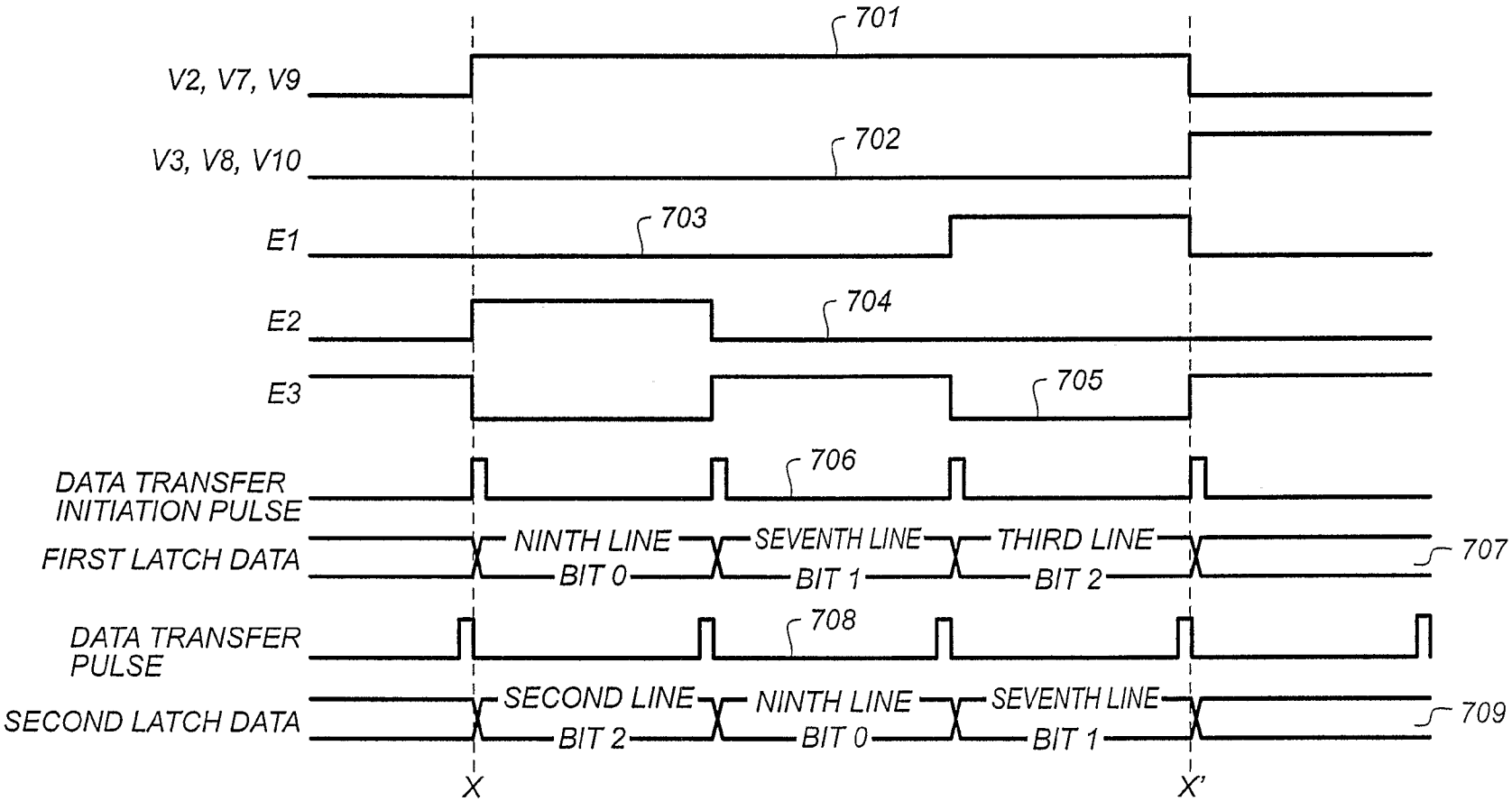
FIG. 7 is a timing chart for time-divisional selection.

FIG. 7 is a timing chart illustrating time divisional selection of the second, seventh, and ninth lines in the period X-X' in FIG. 6.

The figure shows a pulse 701 of outputs V2, V7, and V9 from the shift registers in the second, seventh, and ninth stages, respectively, and a pulse 702 of outputs V3, V8, and V10 from the shift registers in the third, eighth, and tenth stages, respectively. The figure also shows enable pulses 703, 704, and 705 of the lines E1, E2, and E3, a data transfer initiation pulse 706 provided to the shift register 301 of the data driver 102, data 707 of the first latch 302, a transfer pulse 708 for transferring the data of the first latch 302 to the second latch 303, and data 709 of the second latch 303.

The data transfer initiation pulse 706 provided to the shift register in the first stage of the data driver 102 is sequentially transferred by the shift register 301, and data for one line is taken into the first latch. After the data for one line is taken into the first latch, the data transfer pulse 708 is provided to the data transfer control line 312, and the first latch data for one line is collectively transferred to the second latch.

For correcting the voltage Vth of the ON current generation TFT 1602, the data transfer pulse 708 is provided to the output control line 1610, and the voltage Vth can be corrected during the "High" period.

While the value of the second latch data 709 is output to the data line 107 by the output circuit 304, and written into the pixel as the ON current or the OFF voltage, the figure does not show the signal on the data line 107 because the written information is determined by the second latch data.

During the first one-third of the period X-X', the lines E1, E2, and E3 are "Low", "High", and "Low", respectively, and therefore the pulse of the output V2 is enabled by the enable circuit, thereby activating the select line for the second line. At this time, the data in the second latch 303 is bit 2 data of the second line, so that this data is written to the pixel in the second line, display of the sub frame SF1 is terminated, and display of the sub frame SF2 is initiated.

Because the lines E1, E2, and E3 are "Low", "Low", and "High", respectively, in the second section, the pulse of the output V9 is enabled by the enable circuit, thereby activating the select line for the ninth select line. At this time, the data in the second latch 303 is bit 0 data of the ninth line, so that this data is written to the pixel in the ninth line, display of the sub frame SF3 is terminated, and display of the sub frame SF0 is initiated.

In the last section, the lines E1, E2, and E3 are "High", "Low", and "Low", respectively, and, therefore, the pulse of the output V7 is enabled by the enable circuit, thereby activating the gate line for the seventh line. At this time, the data in the second latch 303 is bit 1 data of the seventh line, so that this data is written to the pixel in the seventh line, display of the sub frame SF0 is terminated, and display of the sub frame SF1 is initiated.

Figure 8:
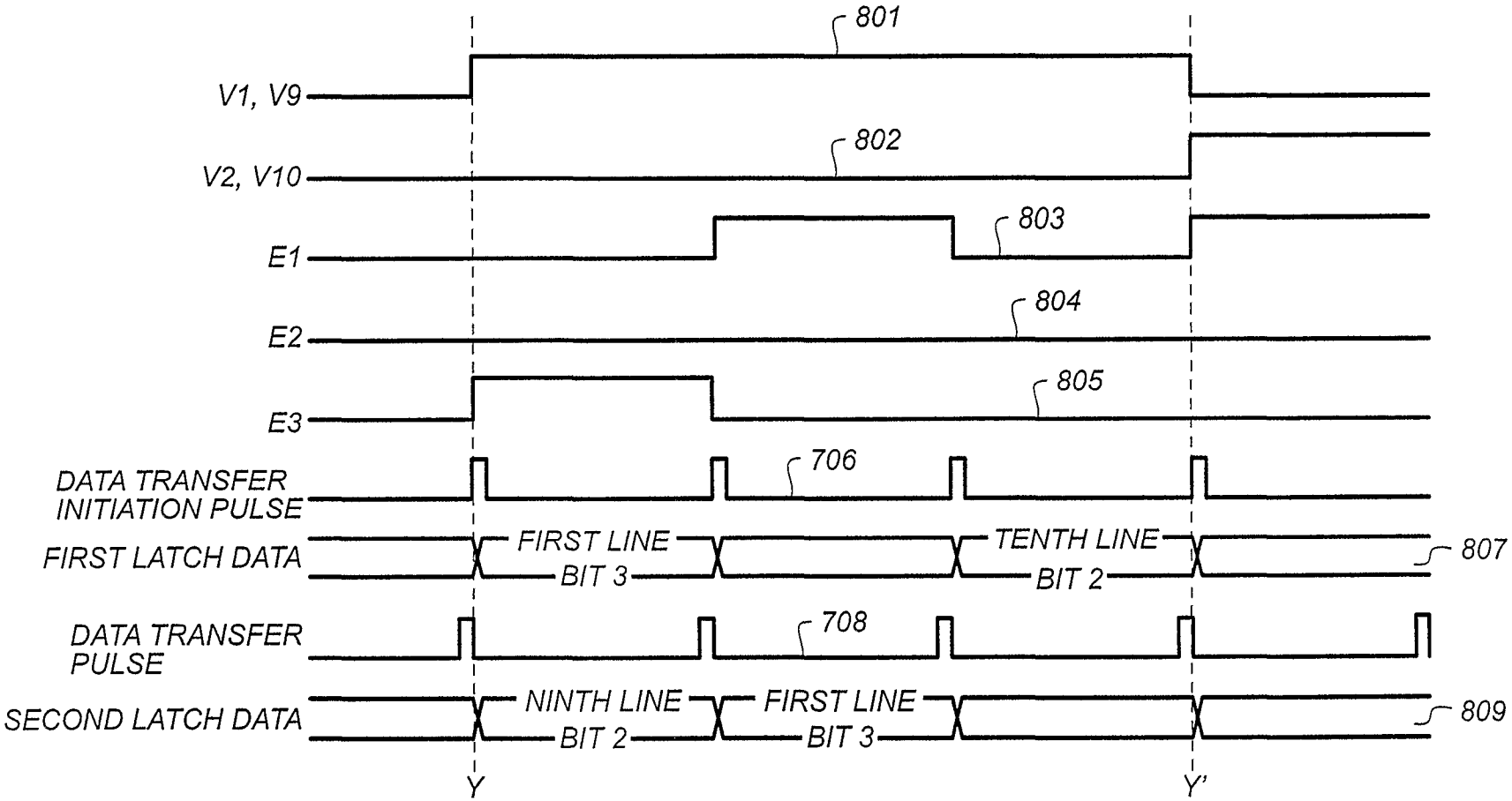
FIG. 8 is a timing chart for time-divisional selection.

FIG. 8 is a timing chart for time divisional selection in a period Y-Y' in FIG. 6. The figure shows a pulse 801 of the outputs V1 and V9, a pulse 802 of the outputs V2 and V10, enable signals 803, 804, and 805 of the lines E1, E2, and E3, respectively, and data 807 and 809 of the first and second latches 302 and 303, respectively.

In the first one-third of the period Y-Y', the lines E1, E2, and E3 are "Low", "Low", and "High", respectively, and therefore the pulse of the output V9 is enabled by the enable circuit, thereby activating the select line for the ninth line. At this time, the data in the second latch 303 is bit 2 data of the ninth line, so that this data is written to the pixel in the ninth line, display of the sub frame SF1 is terminated, and display of the sub frame SF2 is initiated.

Because the lines E1, E2, and E3 are "High", "Low", and "Low", respectively, in the next section, the pulse of the output V1 is enabled by the enable circuit, thereby activating the select line for the first line. At this time, the data in the second latch 303 is bit 3 data of the first line, so that this data is written to the pixel in the first line, display of the sub frame SF2 is terminated, and display of the sub frame SF3 is initiated.

None of the lines E1-E3 is "High" in the last section, and therefore no select line is activated.

Although the above description relates to the example in which only 10 lines are provided in total and one frame is divided into sub frames SF0-SF3, as illustrated in FIG. 6, such a driving method makes it possible to write bit data into each pixel in a time-divisional manner without any inconsistency.

Figures 9, 10:
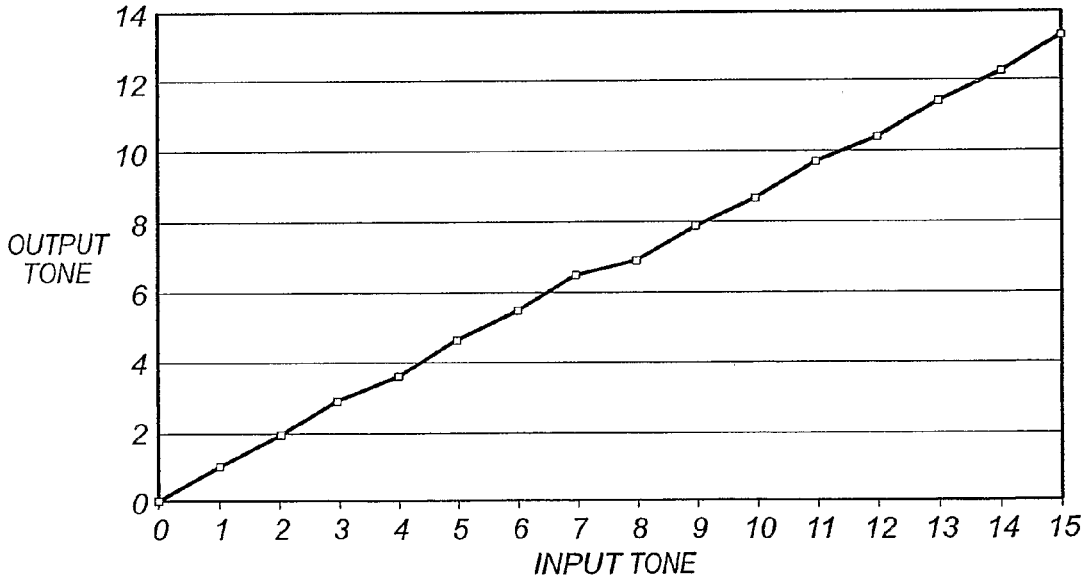
FIG. 9 is a table for setting the sub frames for 4-bit, 16-tone digital driving.
FIG. 10 shows characteristics of input and output tones of 4-bit, 16-tone display.

FIG. 9 is a table showing, for the sub frames SF0-SF3, the time-divisional selection order, the pulse intervals P0-P3, the sub frame periods (from the time the current sub frame is initiated to the time the next sub frame is initiated), and the ratio T1-T3 to the sub frame period T0 of the sub frame SF0.

FIG. 10 shows input/output tone characteristics obtained when the tone is generated with the sub frame periods of FIG. 9. It is understood from the graph that the tone level can be generated without inversion for the increasing input tone in accordance with the table of FIG. 9.

Data Processing

Figure 11:
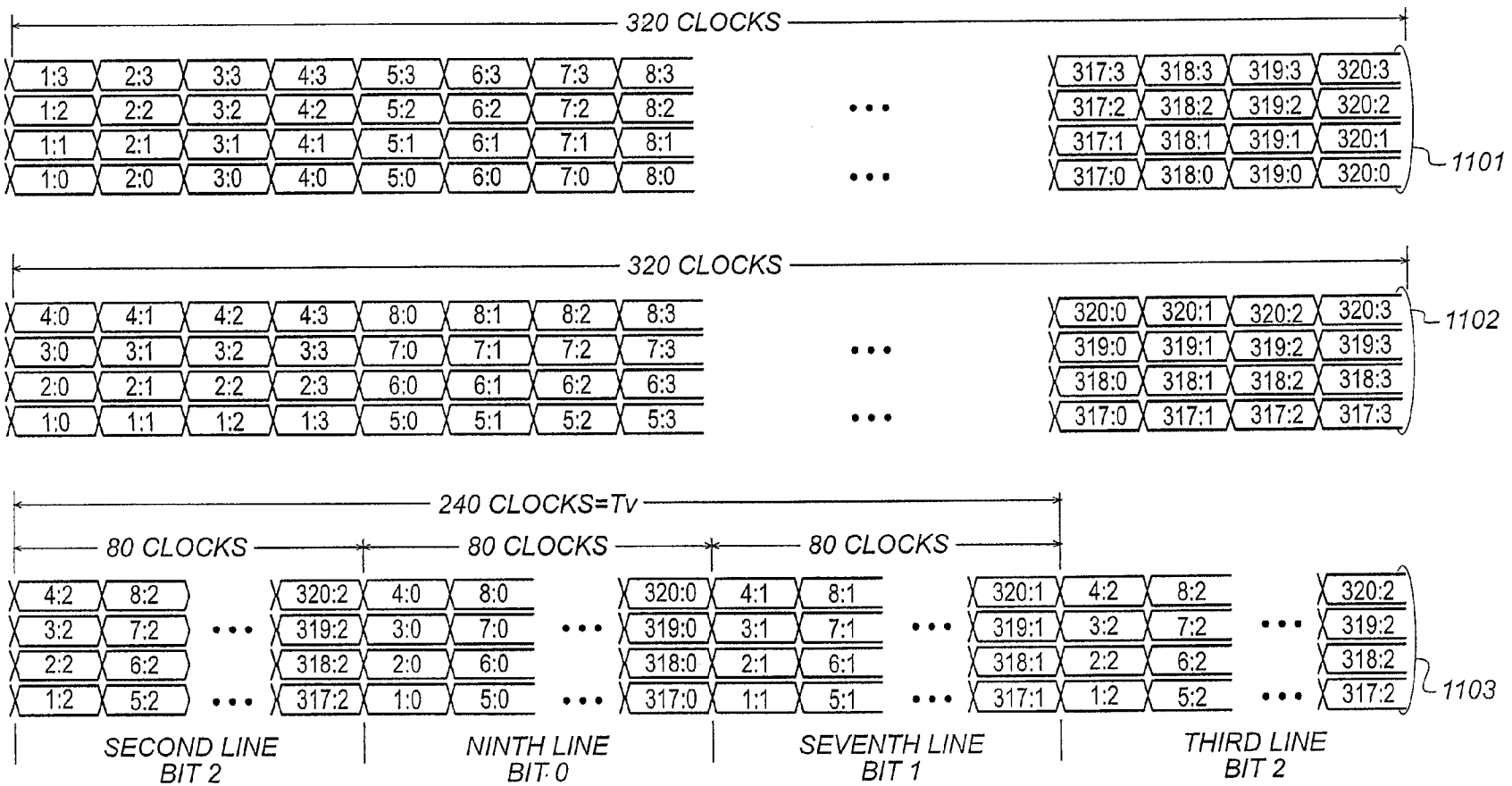
FIG. 11 is a data processing timing chart for 4-bit, 16-tone digital driving.

FIG. 11 shows the timing of data processing performed by the data control circuit 106 using the frame memory 121 in order to store data in the second latch with the timing shown in FIGS. 7 and 8.

The figure shows input data 1101 supplied from the input bus 111, data 1102 generated by the control circuit 106 and written into the frame memory 121, and data 1103 read out from the frame memory 121.

While video data supplied from the input bus 111 includes the data for three channels, i.e. R, G, and B, in a full color display, only the data for one channel is shown in FIG. 11 because the same operation is performed for R, G, and B.

The bit data "a:b" indicates bit "b" data of the $a^{th}$ data in one line data. For example, data 1:0 refers to the bit 0 data of the first data, and data 320:3 refers to the bit 3 data of the $320^{th}$ data.

FIG. 11 shows an example in which data of a line having 320 pixels is supplied in 320 clocks. The supplied data 1101 is sorted for every 4 pixel data items each having the consecutive 4 bits, so that bit 0 data, bit 1 data, bit 2 data, and bit 3 data for the consecutive 4 pixels are rearranged to produce data 1102.

The thus-sorted bit data 1102 is written into the frame memory 121 in 320 clocks.

For readout in, for example, the period X-X', bit 2 data of the second line, bit 0 data of the ninth line, and bit 1 data of the seventh line must be supplied in this order. Referring to FIG. 11, data for 320 pixels is read out from the bit 2 data of the second line in 80 clocks, bit 0 data of the ninth line is read out in the next 80 clocks, and bit 1 data of the seventh line is read out in the subsequent 80 clocks.

By thus reading out data from the frame memory 121, data required upon time-divisional selection can be supplied.

Multi-tone Driving Method

While 4-bit, 16-tone display is described above as an example, 6-8 bit, i.e. 64-256 tone, display is desired for actual displays used in personal digital assistants and the like. The above-described driving method is also applicable to such multi-tone displays.

With the configuration of the gate driver 103, however, the number of lines is limited to a maximum of three to achieve time-divisional selection. Next, a digital driving method for achieving 8-bit, 256-tone display with such a configuration will be described.

For 8-bit, 256-tone display, the ratio of periods T0:T1 . . . :T7 is set as 1:2 . . . :128, and sub frames ranging from that for a shorter light emission period to that for a longer light emission period are required. A shorter sub frame has a close pulse interval, and requires a greater number of enable control lines to select a gate line in a time-divisional manner. On the other hand, a longer sub frame is likely to cause a flicker because the frequency is low during the ON period.

Figures 12, 13:
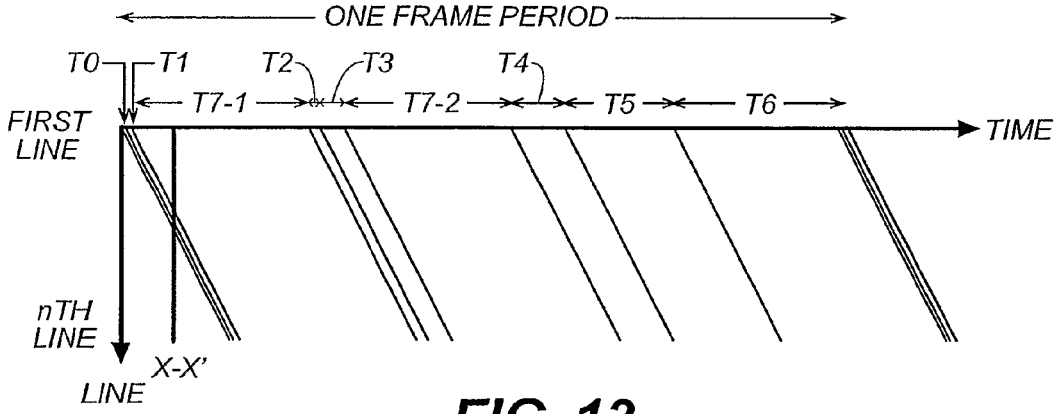
FIG. 12 is a table for setting the sub frames for 8-bit, 256-tone digital driving.
FIG. 13 is a sub frame chart for 8-bit, 256-tone digital driving.

In view of the above, the pulse intervals P0-P7, and the order of time-divisional selection are set as shown in FIG. 12. Note that the sub frames SF7-1 and SF7-2 have the pulse intervals P7-1 and P7-2 obtained by, for example, equally dividing the pulse duration of SF7 in order to achieve digital driving with three enable control lines.

Because two pulse intervals P7 correspond to the bit data 7, data items for P7-1 and P7-2 coincide with each other.

FIG. 13 shows 8-bit, 256-tone driving sequence with the sub frame SF7 divided into two. In the figure, time is plotted in the horizontal axis, and the select line is plotted in the vertical axis.

Figure 14:
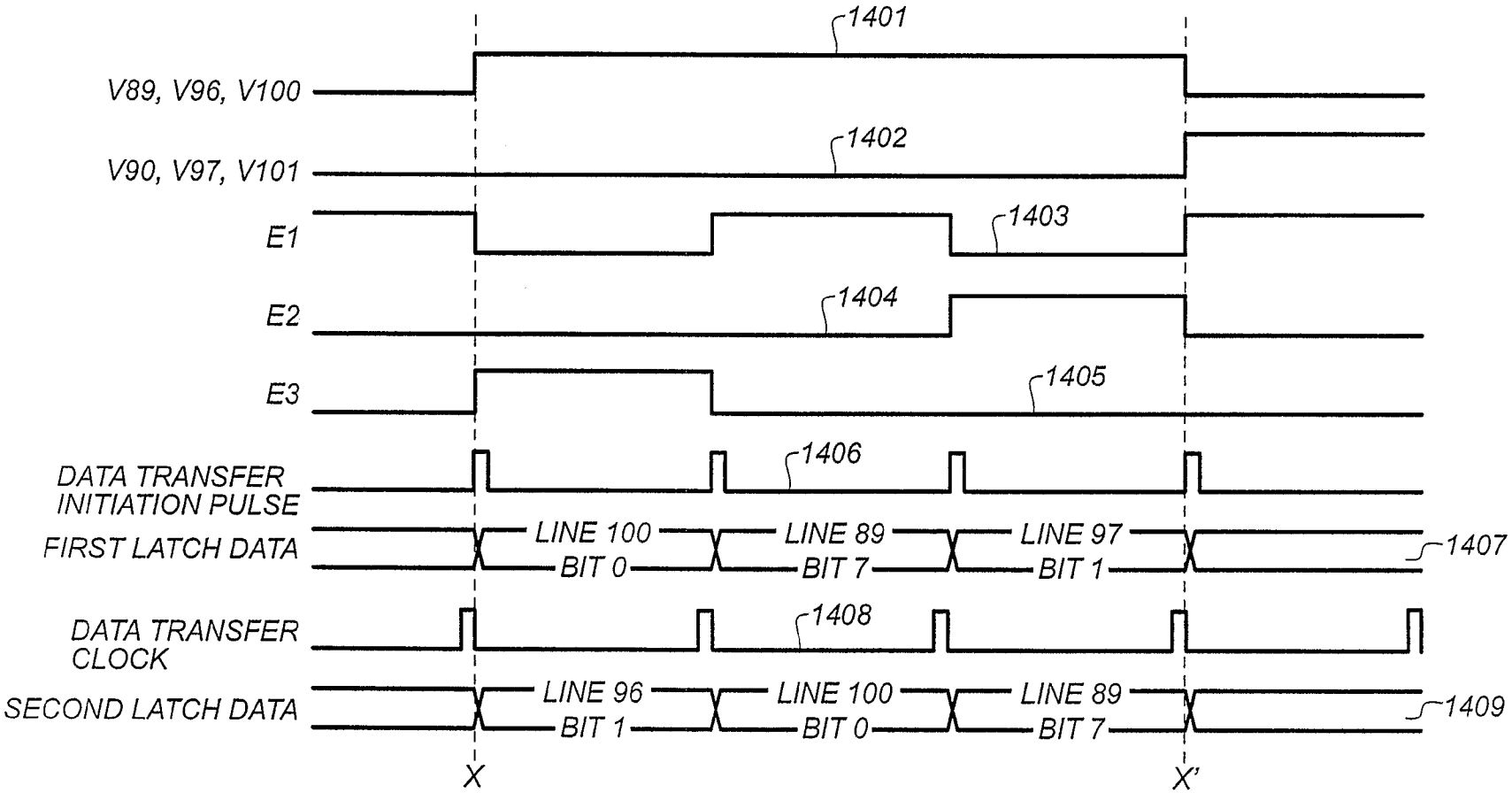
FIG. 14 is a timing chart for time-divisional selection.

In a panel having 240 lines, for example, in the period X-X' shown in FIG. 14 in which the select line to which data of the sub frame SF0 is written is the $100^{th}$ line, the select line for the sub frame SF1 is that of the $96^{th}$ line, the select line of the sub frame SF7-1 is that of the $89^{th}$ line, as can be seen from FIG. 12, and the subsequent lines do not exist on the screen.

FIG. 14 is a time-divisional timing chart in the period X-X', showing a pulse 1401 of the shift register outputs V89, V96, and V100, a pulse 1402 of the shift register outputs V90, V97, and V101, enable pulses 1403, 1404, and 1405 of the enable control lines E1, E2, and E3, respectively, a data transfer initiation pulse 1406 supplied to the first stage of the shift register in the data driver 102, data 1407 of the first latch 302, a pulse 1408 for transferring the data in the first latch 302 to the second latch 303, and data 1409 in the second latch 303.

In the first one-third of the period in which the pulse of the shift register outputs V89, V96, and V100 is "High", the lines E1, E2, and E3 are "Low", "Low", and "High", respectively. Consequently, the enable circuit connected to the line E3 enables the signal of the output V96, thereby activating the select line for the $96^{th}$ line. At this time, the bit 1 data of the line 96 is stored in the second latch 303, so that the data is written into the pixel of the $96^{th}$ line, and displayed for the period T1.

In the second period, the lines E1, E2, and E3 are "High", "Low", and, "Low", respectively. Consequently, the enable circuit connected to the line E1 enables the signal of the output V100, thereby activating the select line for the $100^{th}$ line. At this time, the bit 0 data of the line 100 is stored in the second latch 303, so that the data is written into the pixel of the $100^{th}$ line, and displayed for the period T0.

In the last period, the lines E1, E2, and E3 are "Low", "High", and, "Low", respectively. Consequently, the enable circuit connected to the line E2 enables the signal of the output V89, thereby activating the select line for the $89^{th}$ line. At this time, the bit 7 data of the line 89 is stored in the second latch 303, so that the data is written into the pixel of the $89^{th}$ line, and displayed for the period T7-1.

Figure 15:
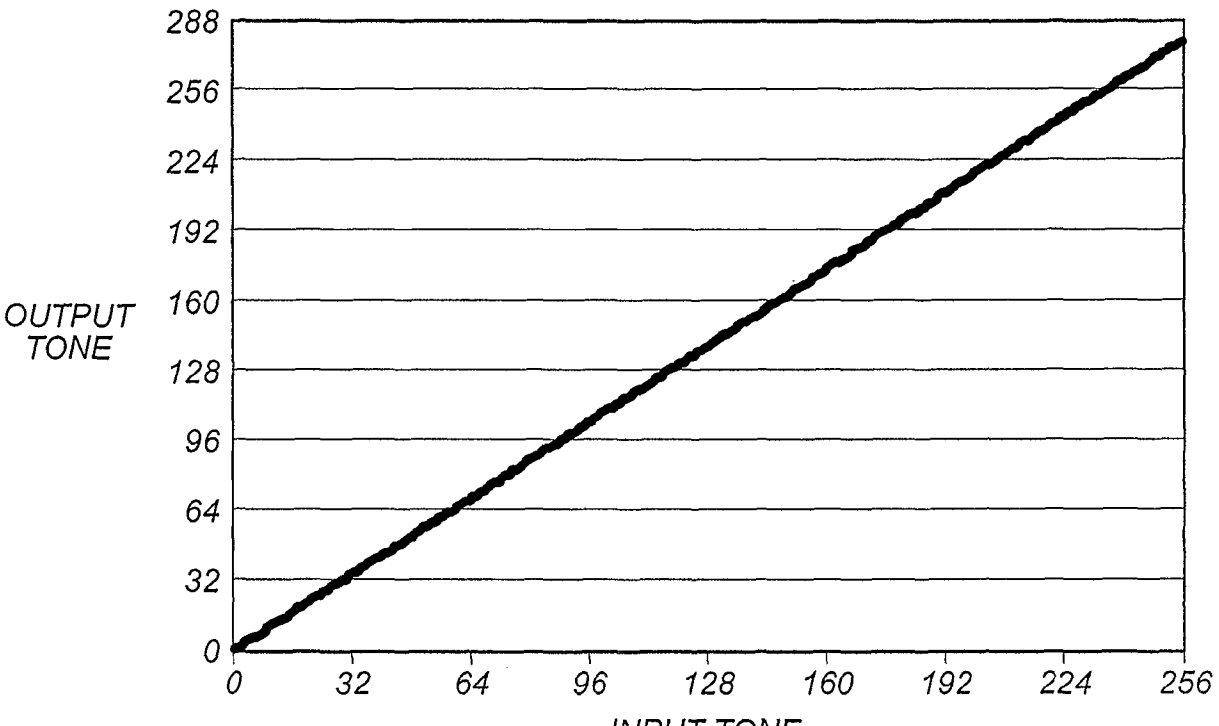
FIG. 15 shows characteristics of input and output tones of 8-bit, 256-tone display.

FIG. 15 shows the characteristics of the input and output tones obtained by 256-tone display with the sub frame periods T0-T7 in FIG. 12.

By thus inserting part of the sub frame having a long sub frame interval into the portion where the sub frame interval is close, multi-tone display can be achieved with three enable control lines.

Second Embodiment

Pixel Circuit Configuration

Figure 20:
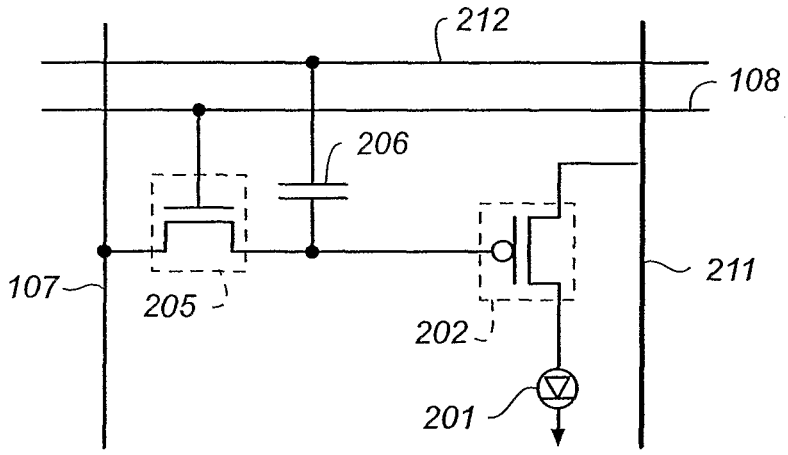
FIG. 20 shows a configuration of a pixel circuit.

FIG. 20 shows a conventionally used pixel circuit in which the diode switch TFT 203 and the light control TFT 204 are not provided and the drain terminal of the driving TFT 202 is connected to an anode of the organic EL element 201.

The pixel circuit of FIG. 20 has fewer transistors, and therefore the area of the circuit is relatively small. Consequently, this circuit provides an advantage of improved aperture ratio, allowing formation of panels with a higher resolution.

Pixel Driving Method

The pixel circuit is driven using the data driver 102, the gate driver 103, and the auxiliary circuit 305, as explained in the following.

When the output circuit 304 in the data driver 102 provides the ON current to the data line 107 to activate the select line 108 and the auxiliary circuit enable line 313, the auxiliary circuit 305 is connected to the data line 107, and the ON current on the data line 107 is supplied to the auxiliary circuit 305.

Assuming that the driving TFT of the auxiliary circuit 305 has the current supplying capability x times (where x is a positive real number) that of the driving TFT of the pixel circuit, and that the current x*i is supplied to the data line 107, no current is supplied to the pixel circuit, and the current x*i is supplied to the auxiliary circuit.

The potential for causing the driving TFT of the auxiliary circuit to supply the current x*i is generated in the data line 107, and written into the pixel circuit.

Because the driving TFT of the pixel circuit has the current supplying capability one xth (1/x) of that of the driving TFT of the auxiliary circuit, the current "i" is generated for the written potential.

When the select line 108 is deactivated, the above potential is stored in the storage capacitor 206 until it is next accessed, to thereby keep driving the organic EL element 201 with the current "i".

However, when the driving TFTs of the pixel circuit and the auxiliary circuit have different properties, the current 1/x of that on the data line cannot be evenly supplied to the organic EL element.

In view of the above, with the configurations shown in FIGS. 18A and 18B with a plurality of auxiliary circuits, correction can be made by, for example, as in FIG. 18A, selecting one auxiliary circuit having similar properties or changing the auxiliary circuit connected to the data line for each line.

The configurations of FIGS. 18A and 188B allow correction of the properties by combination of several auxiliary circuits, and the combination can be varied for each line.

Third Embodiment

Overall Configuration

Figure 19:
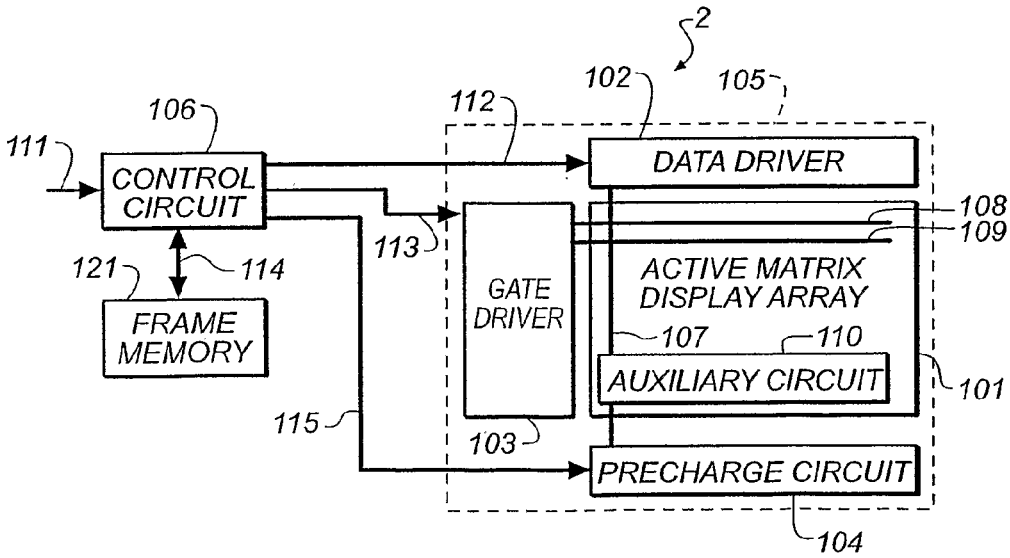
FIG. 19 shows an overall configuration of a device according to a third embodiment of the present invention.

FIG. 19 shows an overall configuration of a device according to a third embodiment of the present invention.

An organic EL display 2 includes, in addition to the elements of the organic EL display 1 of FIG. 1, a precharge circuit 104 connected to the data line 107 for supplying a predetermined precharge potential, and a precharge enable line 115.

When the precharge circuit 104 is provided, the output circuit 304 of the data driver 102 need not supply the OFF potential. As a result, the OFF potential switch TFT 1601 need not be provided in the configuration of the output circuit in FIGS. 16A and 16B.

Driving Method

A digital driving method using the precharge circuit 104 will be described below.

Figure 21:
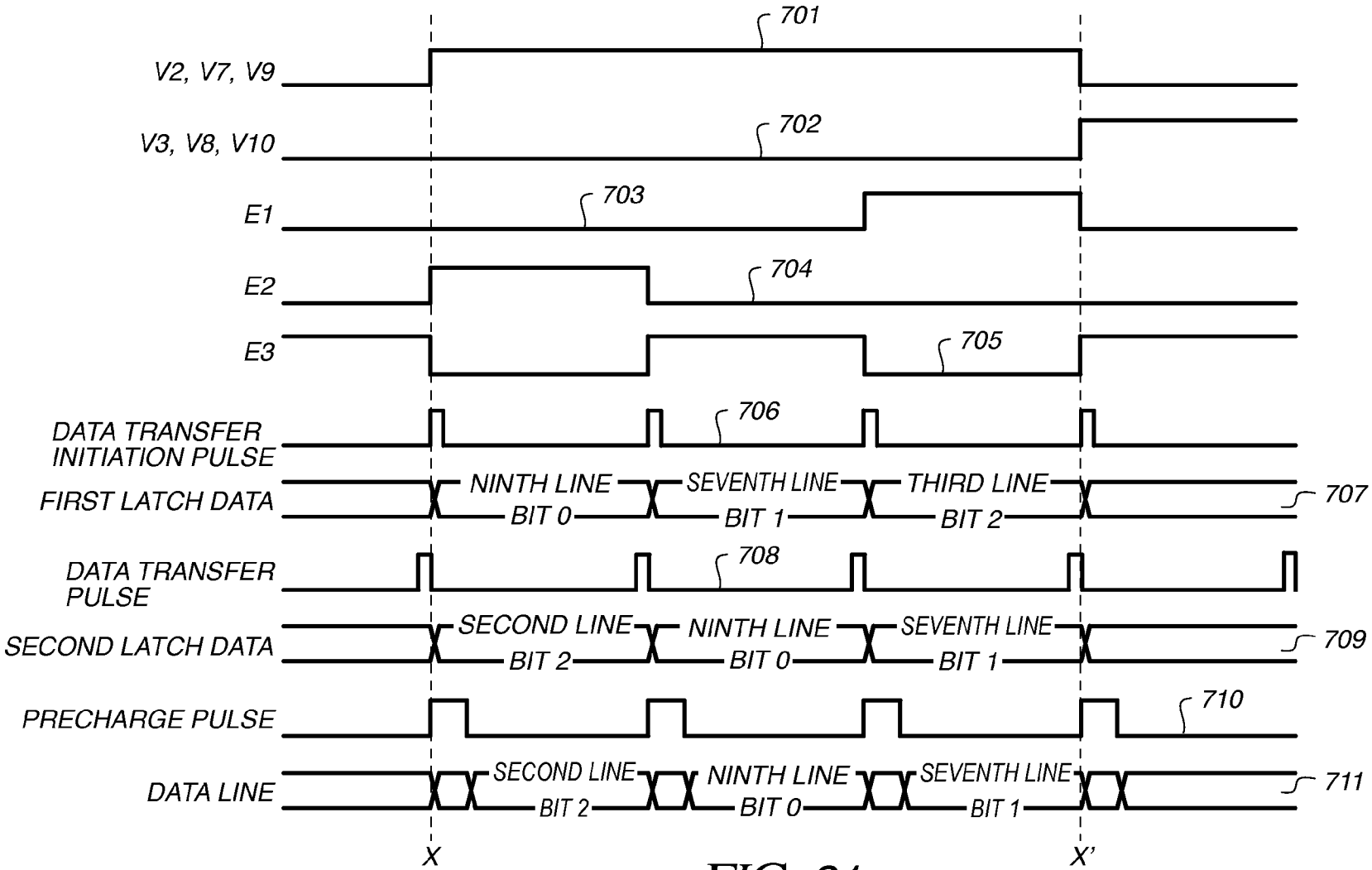
FIG. 21 is a time-divisional timing chart.

FIG. 21 is a time-divisional selection timing chart in the period X-X' of FIG. 6, showing a precharge pulse 710 supplied to the precharge enable line 115, and a data signal 711 on the data line 107.

Referring to FIG. 21, in the first half of each tripartite selection period, the precharge enable line is active, so that the precharge potential is first supplied to the data line 107.

When the first and second select lines 108 and 109 in the pixel circuit of FIG. 2 are activated, the precharge potential is first written into the pixel. This precharge potential is at the level turning off the driving TFT 202, i.e. the OFF potential.

When the auxiliary circuit 110 is connected to the data line 107 and the output circuit 304 of the data driver 102 supplies the ON current, the data current is then supplied to the data line 107, and the data current in accordance with the current supplying capabilities of the driving TFT of the auxiliary circuit and the driving TFT in the pixel is written into the pixel circuit.

When the output of the output circuit 304 of the data driver 102 which does not include the OFF potential switch 1601 becomes high impedance, the OFF potential supplied to the precharge circuit 104 is maintained in the data line 107, and therefore the OFF potential is held in the pixel.

The driving method following the above-described step is the same as that of the first embodiment, and similar current-driving type digital driving can be achieved.

PARTS LIST

1 organic EL display
101 active matrix display array
102 data driver
103 gate driver
104 precharge circuit
105 display device
106 control circuit
107 data line
108 first select line
109 second select line
110 auxiliary circuit
111 input bus
112 control bus
113 gate control bus
114 memory bus
115 precharge enable line
121 frame memory
201 organic EL element
202 driving TFT
203 diode switch TFT
204 light control TFT
205 gate TFT
206 storage capacitor
211 current supply line
212 fixed potential line

301 shift register
302 latch circuit
303 latch circuit
304 output circuit
305 individual auxiliary circuit
311 data bus
312 data transfer control line
401 shift register
402 enable circuit
403 level shifter
404 buffer
701 pulse
702 pulse
703 enable pulse
704 enable pulse
705 enable pulse
706 initiation pulse
707 data
708 transfer pulse
709 data
710 precharge pulse
711 data signal
801 pulse
802 pulse
803 enable signal
804 enable signal
805 enable signal
807 data
809 data
1101 input data
1102 data
1103 data
1401 pulse
1402 pulse
1403 enable pulse
1404 enable pulse
1405 enable pulse
1406 initiation pulse
1407 data
1408 pulse
1409 data
1600 input unit
1601 switch TFT
1602 current generation TFT
1603 level shifter
1604 reset TFT
1605 reset TFT
1606 P channel switch TFT
1607 P channel switch TFT
1608 resent capacitor
1610 output control line

The invention claimed is:

1. A display device, comprising:

an active matrix display array including pixel circuits arranged in a matrix of columns and rows, each pixel circuit having a current-driven diode emissive element, and a plurality of thin film transistors for controlling the diode emissive element;

a data line provided corresponding to each column of the matrix for supplying a data signal to a pixel circuit in the corresponding column;

a data driver for controlling supply of the data signal to the data line;

a select line provided corresponding to each row of the matrix for supplying a select signal to the pixel circuit in the corresponding row, the select line includes at least a first select line and a second select line; and a gate driver for supplying the select signal to the select line;

wherein the data signal is a digital signal indicating "1" or "0" as to whether or not to supply ON or drive current to the diode emissive element, and wherein the at least first select sub-line and second select sub-line are controlled in opposite polarities to each other.

2. The display device according to claim 1, wherein:

the data driver supplies a predetermined OFF potential to the data line when the ON or drive current is not to be supplied.

3. The display device according to claim 1, further comprising:

a precharge circuit for supplying a predetermined precharge voltage to the data line before the data signal is supplied, wherein the precharge circuit supplies a predetermined OFF potential to the data line.

4. The display device according to claim 1, wherein each pixel includes a plurality of sub frames, and the data driver determines "1" or "0" of the data signal in the plurality of sub frames within one frame for each pixel based on display data for each pixel in one frame, and supplies the data signal to the data line for each sub frame.

5. The display device according to claim 4, wherein:

the data driver sequentially supplies to one data line the data signal for a pixel in a different sub field and a different row, and the gate driver sequentially selects a select line for a row to which the data signal supplied to the data line is to be supplied in synchronism with the supply of the data signal.

6. The display device according to claim 1, further comprising:

an auxiliary circuit connected to the data line, wherein the auxiliary circuit is capable of supplying part of the ON current of the data signal supplied from the data driver to the data line.

7. The display device according to claim 6, wherein:

the auxiliary circuit includes a transistor for supplying part of the ON current supplied to the data line, and a capacitor for storing a gate voltage of the transistor in this state, and the pixel circuit drives the diode emissive element with a current in accordance with the voltage stored in the capacitor of the auxiliary circuit.

8. The display device according to claim 6, wherein:

the auxiliary circuit has a current supplying capability larger than that of the pixel circuit.

9. The display device according to claim 6, wherein:

the auxiliary circuit is composed of a plurality of auxiliary circuits having different current supplying capabilities for one data line.

10. The display device according to claim 6, wherein:

the auxiliary circuit is provided to be connectable to data through a switch, and is connected to the data line at least once in a horizontal period.

11. The display device according to claim 6, wherein:

the data driver is capable of supplying a plurality of data currents to the data line for the same data voltage, and the plurality of data currents are switched within one horizontal period.

12. The display device according to claim 11, wherein:

the plurality of data currents are supplied to the data line as a current larger than a data current written to a pixel in a first half of one horizontal period.

* * * * *